US010000087B2

(12) United States Patent
Pedersen

(10) Patent No.: US 10,000,087 B2
(45) Date of Patent: Jun. 19, 2018

(54) METHOD FOR DETACHABLE POSTER HANGING AND MAGNETIC POSTER HOLDER DEVICE

(71) Applicant: TP Holding Hadsund APS, Hadsund (DK)

(72) Inventor: Tomas Pedersen, Hadsund (DK)

(73) Assignee: MAGSEE GMBH (DE)

( * ) Notice: Subject to any disclaimer, the term of this patent is extended or adjusted under 35 U.S.C. 154(b) by 0 days. days.

(21) Appl. No.: 15/512,567

(22) PCT Filed: Sep. 1, 2015

(86) PCT No.: PCT/DK2015/050256

§ 371 (c)(1),
(2) Date: Mar. 19, 2017

(87) PCT Pub. No.: WO2016/045677

PCT Pub. Date: Mar. 31, 2016

(65) Prior Publication Data

US 2017/0203605 A1 Jul. 20, 2017

(30) Foreign Application Priority Data

Sep. 22, 2014 (DK) ..... 2014 00538
Oct. 10, 2014 (DK) ..... 201 70627

(51) Int. Cl.
*B42F 15/06* (2006.01)
*G09F 1/10* (2006.01)
(Continued)

(52) U.S. Cl.
CPC ..... *B42F 15/066* (2013.01); *A47F 7/143* (2013.01); *B44C 5/02* (2013.01); *G09F 1/103* (2013.01);
(Continued)

(58) Field of Classification Search
CPC ..... G09F 2007/186; G09F 2007/1847; G09F 2007/1852; G09F 1/1856; G09F 7/18;
(Continued)

(56) References Cited

U.S. PATENT DOCUMENTS 3,643,362 A * 2/1972 Hackett ..... G09F 1/10 40/607.04
4,255,837 A * 3/1981 Holtz ..... B42F 11/04 24/303

(Continued)

FOREIGN PATENT DOCUMENTS

| | | |
|---|---|---|
| DE | 20 2009 000282 | 5/2009 |
| EP | 1 624 429 | 2/2006 |
| WO | 03/074808 | 9/2003 |

*Primary Examiner* — Patrick D Hawn
(74) *Attorney, Agent, or Firm* — Ware, Fressola, Maguire & Barber LLP

(57) ABSTRACT

The invention relates to a magnetic poster holder unit, where a v- or u-shaped magnet clip in the bottom is provided with a magnet. According to the invention, the magnet clip is in the top, on the outer side, designed with notches, whereby the magnet clip can be clicked into a hanging profile, which has an inner shape, which corresponds to the outer shape of the magnet clip, such that the magnet clip's notch by insertion in the hanging profile can provide a mechanical locking and thereby fixation between the magnet clip and the hanging profile. The invention also relates to a method for detachable hanging of poster of flat, flexible length material along a poster edge, where the poster edge includes magnetic items and where the poster edge's magnetic items are brought to contact against a magnet clip containing corresponding magnetic items.

7 Claims, 9 Drawing Sheets

(51) Int. Cl.

| | |
|---|---|
| ***B44C 5/02*** | (2006.01) |
| ***A47F 7/14*** | (2006.01) |
| ***G09F 7/18*** | (2006.01) |
| ***G09F 7/20*** | (2006.01) |
| *G09F 15/00* | (2006.01) |

(52) U.S. Cl.
CPC ..... *G09F 7/18* (2013.01); *G09F 7/20* (2013.01); *G09F 15/0018* (2013.01); *G09F 2007/1852* (2013.01); *G09F 2007/1856* (2013.01)

(58) Field of Classification Search
CPC ..... G09F 7/20; G09F 7/04; G09F 15/0018; G09F 1/103; B42F 15/066; A47G 1/1686; A47F 7/143; B44C 5/02
USPC ..... 40/658
See application file for complete search history.

(56) References Cited

U.S. PATENT DOCUMENTS 4,564,165 A * 1/1986 Grant ..... E04B 9/006 248/317
5,381,991 A * 1/1995 Stocker ..... G09F 7/18 248/206.5
5,799,428 A * 9/1998 Poindexter ..... G09F 1/103 248/215
6,088,942 A * 7/2000 Brooks ..... G09F 15/0025 160/328
6,546,658 B2 * 4/2003 Pitcher ..... B42F 15/066 24/489
6,779,771 B2 * 8/2004 Ostrovsky ..... F01D 15/10 24/67.1
7,373,748 B2 * 5/2008 Pitcher ..... G09F 7/00 24/462
7,487,611 B2 * 2/2009 Robb ..... G09F 3/204 40/658
7,673,409 B2 * 3/2010 Pitcher ..... G09F 7/18 248/316.7
7,722,100 B2 * 5/2010 Suciu ..... A47F 5/0892 248/544
7,743,541 B2 * 6/2010 Suciu ..... G09F 3/20 248/229.1
7,823,311 B2 * 11/2010 Pitcher ..... G09F 7/10 40/618
8,251,329 B2 * 8/2012 Suciu ..... G09F 15/0018 248/316.2
8,302,453 B2 * 11/2012 Pedersen ..... B42B 7/00 72/457
8,702,051 B2 * 4/2014 Vanham ..... F16B 5/0692 248/477
2012/0305737 A1 * 12/2012 Pedersen ..... G09F 7/04 248/489

* cited by examiner

METHOD FOR DETACHABLE POSTER HANGING AND MAGNETIC POSTER HOLDER DEVICE

CROSS-REFERENCE TO RELATED APPLICATIONS

This application is a U.S. national stage of International Appl. No. PCT/DK2015/050256 filed 1 Sep. 2015, which claimed priority to Danish Appl. Nos. PA 2014 00538 filed 22 Sep. 2014 and PA 2014 70627 filed 10 Oct. 2014, which applications are all incorporated herein by reference in their entireties.

TECHNICAL FIELD

The invention relates to a method for detachable poster hanging of flat, flexible length material along a poster edge. The poster edge has magnetic items and the poster edge's magnetic items are brought to contact against a magnet clip containing corresponding magnetic items for detachable magnetic fixing of the poster edge against the magnet clip.

BACKGROUND

From DE 202009000282U1 is known a suspension device for posters, where the device includes a rail with a magnet designed to co-operate with a wire in the poster's edge.

Methods of this type have the weakness that the magnet clip is typically not suited for hanging. There is known a system for magnetic suspension, in which the magnets are fixed connected to a suspension profile but hereby this profile becomes less flexible and furthermore, the end user cannot without further ado shorten the profile as needed since the fixed built in magnets also have to be sawed through.

It is the object of the invention to provide a method whereby there is achieved a higher flexibility.

SUMMARY OF THE INVENTION

According to the invention, this is achieved with a method, as defined above, by the magnet clip in advance being detachably connected with a hanging profile by the magnet clip being inserted into the hanging profile in its longitudinal direction or is inserted in the profile's transverse direction.

The hanging rail can now be hanged up without this interfering with the magnet clips and the magnetic items here. Simultaneously, it will be possible to insert alternative fixing items in the hanging rail, for instance items for other mechanical fixing of a poster edge, which can be relevant in the case that the poster does not have an edge with magnetic items.

According to an embodiment of the method, the poster edge is released from the hanging profile by pulling the poster's edge with the magnetic items free from the magnet clip's magnetic items since the number of magnet clips is chosen in relation to the poster's expected load. The magnetic fixing is hereby easy to dimension and there will by correct dimensioning always only have to be added a limited force in order to release the poster from the magnetic fixing in the magnet clip.

Furthermore, the invention relates to a magnetic poster holder unit with a hanging profile where a magnet clip is u- or v-shaped and in the bottom, where the v-shape's legs meet, is provided with a magnet and where the magnet clip in the top, where the v-shape's legs end, on the external side is designed with notches, whereby the magnet clip can be clicked into the hanging profile, which has an inner shape, which corresponds to the outer shape of the magnet clip such that the magnet clip's notch by insertion in the hanging profile can provide a mechanical locking and thereby fixation between the magnet clip and the hanging profile.

By this poster holder unit is achieved possibility of simple assembly and/or disassembly of a hanging profile and magnet clips such that magnet clips with magnetic items can easily and unhindered be inserted and mechanically fixed in the hanging profile. The corresponding inner shapes of the hanging profile and the outer shape of the magnet clips ensure a mechanical locking such that the magnet clips do not become released from the poster holder unit without the user's intention. On the other side, the choice of a profile for hanging and magnet clips for fitting in it contributes to making it relatively easy to displace magnet clips in place in the hanging profile in its longitudinal direction.

In an embodiment, the hanging profile consists of an extruded profile in light metal or polymeric material or the profile is designed in wood. The fact that the hanging profile is relatively easy to manufacture as a profile in metal, plastic or wood makes it possible to have profitable production in both large and small series. Also, the 3 materials give the user possibility of shortening profiles, as needed and desired, himself.

In an embodiment of the invention, the hanging profile includes items for fixing towards wall, ceiling or to a rack. The profile can have all three options built in or just one of them. A possible realization of this is that the hanging profile includes an open C profile provided in connection to the u- or v-profile for fixing of the magnet clips. In such a C-profile, it will be easy to mount different forms of binding agents, brackets or hanging rings, which make wall-, ceiling- or rack mounting simple and straightforward for the user to carry out.

In yet another embodiment, the magnet clip is shorter than the hanging profile such that a number of magnet clips are mountable after each other in the hanging profile's longitudinal direction. Hereby, the user can easily vary the magnetic force by inserting more or less magnet clips in the hanging profile.

According to an additional embodiment, a poster with a metallic magnetic iron-containing edge rail is insertable in the u- or v-shaped magnet clip and detachably fixed hereto by magnetic connection between the poster's edge rail and the magnet or the magnets in the bottom of it or the v- or u-shaped magnet clips. Since the poster's edge rail can be inserted in the magnet clip's v- or u-shaped opening, it is ensured that the edge rail itself of the poster, which can be unbecoming, is out of sight, and it is thus only the poster with illustration or other, which is visible.

In yet another embodiment, the hanging profile includes a u-shaped profile, whereby there on each of the u-profile's legs is provided each own step, which faces towards each other. The steps consist especially appropriate connection items between the magnet clips and the hanging profile and their inwards facing direction also means that the magnet clips will be hidden in between the hanging profile's two legs and thereby not visible for the viewer. The magnet clips can thereby be manufactured without higher regard to their aesthetic appearance.

In an embodiment, the distance between the steps on the hanging profile's u-profile and the distance between external notches in the magnet clips are matching, such that the notches will go in mesh with the steps when the magnet clips are inserted into the hanging profile's u-profile. The correspondence between the distances does not need to be absolute, since there can be accepted a little play. Even with a little play, the fixing will be sufficiently good and if there should be a certain oversize in the distance between the notches on the individual magnet clip, one can also, as a result of the parts' springy characteristics, get the systems to function well anyhow.

BRIEF DESCRIPTION OF THE DRAWINGS

The invention will now be explained more fully with reference to the drawings, on which.

DETAILED DESCRIPTION OF THE INVENTION

Figure 1:
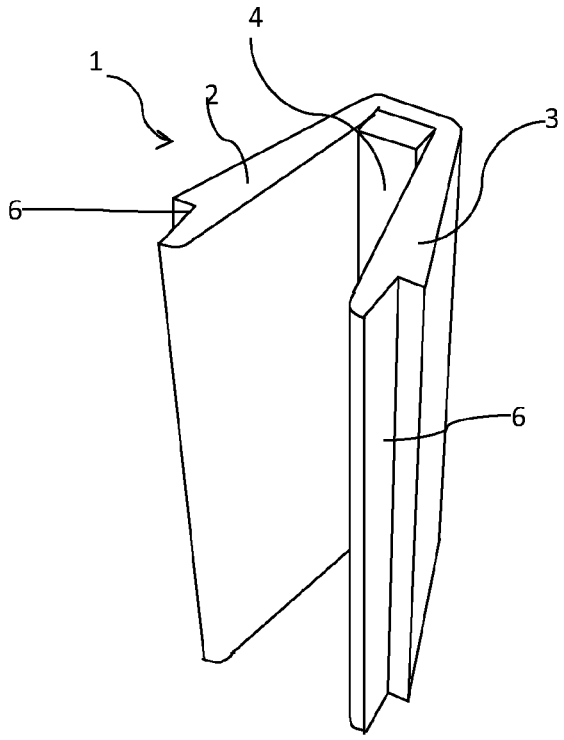
FIG. 1 shows a 3D reproduction of a magnet clip.
Figure 1A:
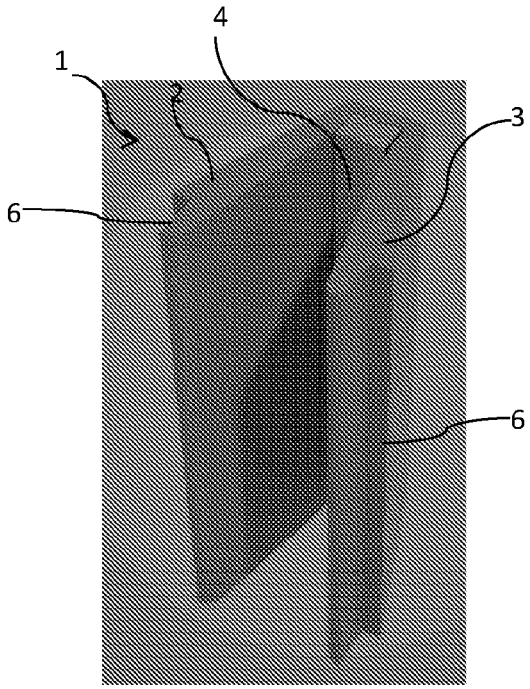
FIG. 1A shows the magnet clip, corresponding to FIG. 1, in a graphic depiction.

In FIG. 1 is seen a v-shaped item consisting of a magnet clip 1, with magnetic items 4 placed between a first leg 2 and another leg 3 of the magnet clip's v-shaped profile. When a poster edge with corresponding magnetic items is inserted between the two legs 2,3 for contact against the magnetic items 4, the pull between the two sets of magnetic items will cause a detachable fixing of the poster edge in the bottom of the magnet clip. Hereby, a poster edge can detachably be hanged along its edge. The magnetic items can actually be polarized permanent magnets mounted in the magnet clip, which are counterbalanced by opposite polarized magnets along a poster edge, or there can be a case of combinations of magnetizable iron and permanent magnets. In the magnet clip, the magnetic items can be embedded, glued on or fixed in other ways, for example by a click connection or screw connection. The poster will typically be shaped by flat, flexible length material, for example woven or felted material or fibrous material such as paper, but also lengths of plastic can be used or combinations of the mentioned.

Figure 5:
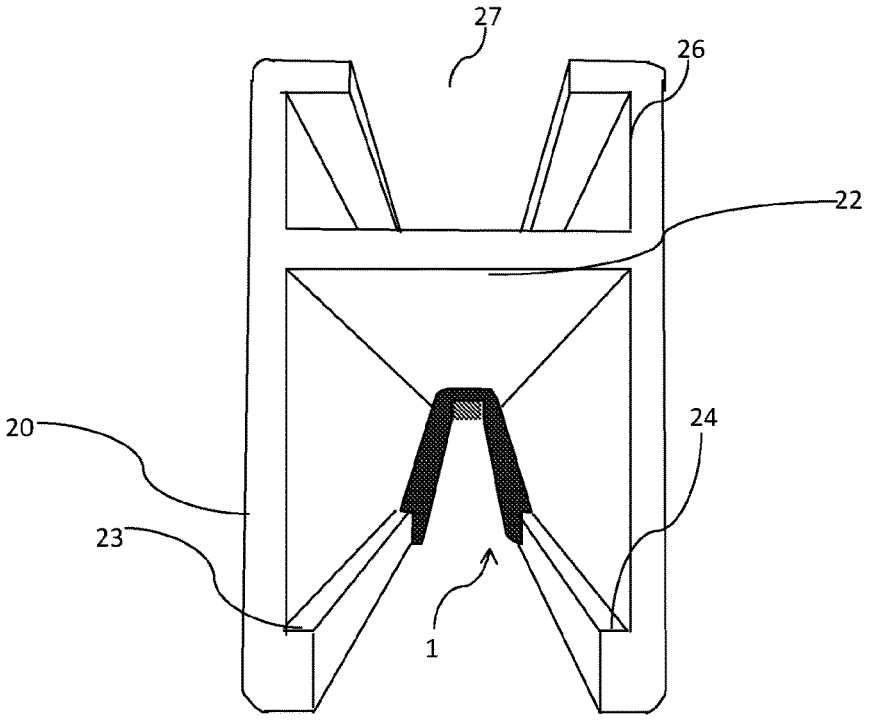
FIG. 5 shows 3D reproduction of hanging profile and magnet clips seen from the end.
Figure 5A:
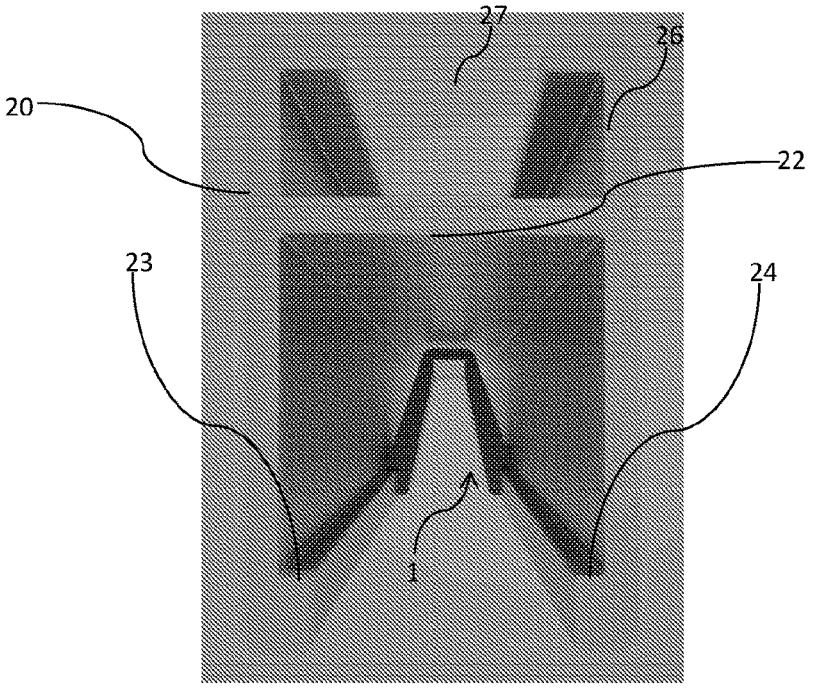
FIG. 5A shows the reproduction in FIG. 5 in a graphical representation.

As it is seen in FIG. 5, the magnet clip 1 is in advance detachably connected with another item such as a hanging profile 20. This occurs by the magnet clip 1 being inserted in the hanging profile in its longitudinal direction or is inserted and clicked into the profile's transverse direction.

Figure 5B:
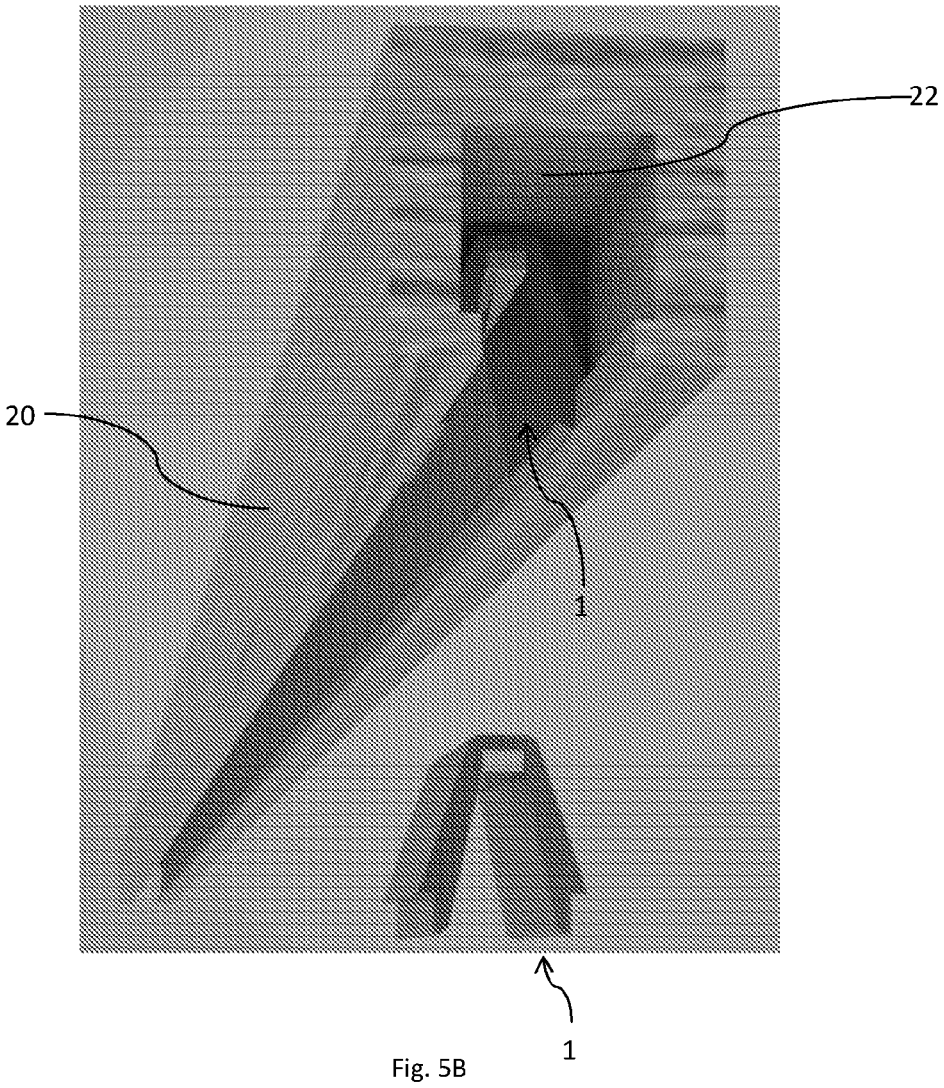
FIG. 5B shows a graphical representation in 3D of a hanging profile and two magnet clips, the one shown clicked in, the other shown outside the hanging profile.

FIG. 5B shows a graphic representation in 3D of a hanging profile and two magnet clips, the one is shown clicked in, the other is shown outside the hanging profile. An optional number of magnet clips can be clicked into the hanging profile's downwards facing U-profile until this is fully filled up with magnet clips, which hereby get to sit very close next to each other. This provides the maximum magnetic holding force. The magnet clips are shown consisting of pieces of a profile with v-shape, but the functionally determined surface, namely surfaces for fixing of magnet and for locking externally towards the hanging profile's internal profile determines not in itself that the magnet clips have uniform cross section in the longitudinal direction. The uniform cross section in the longitudinal direction of the magnet clips is an appropriate choice, but the functional surfaces can also be realized in steps for example several after each other and fixed mounted on a plastic or metal rod.

When a poster is to be released from the hanging profile 20, it occurs easily by pulling the poster's edge, with the magnetic items, free from the magnet clip's 1 magnetic items 4 since the number of magnet clips 1 is chosen in relation to the poster's expected load. Each magnet clip contributes with a certain magnetic holding force on the poster, and here one can insert exactly the number of magnet clips in the hanging profile 20, which is necessary in order to hold a poster with a specific weight or other load fixed in the hanging profile 20.

Figure 2:
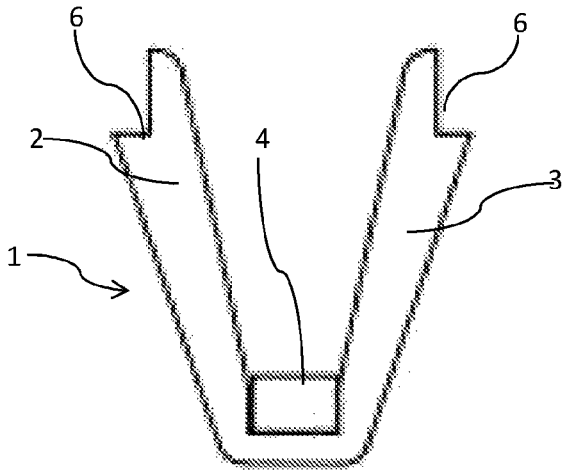
FIG. 2 shows a magnet clip seen from the end.

The magnet clip 1, as shown in FIG. 2, is by the top, on the outer side, designed with notches 6, whereby the magnet clip 1 can be clicked into a hanging profile 20, which has an inner shape, which corresponds to the outer shape of the magnet clip 1 such that the magnet clips' notch 6, by insertion in the hanging profile 20, can provide a mechanical locking and thereby fixation between the magnet clip and the hanging profile. In the shown example, the notches 6 are placed approximately at the end of each leg of the v-shaped profile, which the magnet clip is formed by, but alternatively, the notches could only consist of a profiled end of each leg. Also the v-shape on the magnet clip 1 can be designed in many different ways, and the alternative, both h- and u-profiles could be used. The main reason is that the two legs and an external end of each leg is profiled in relation to the hanging profile's inner measurements.

The hanging profile typically consists of an extruded profile in light metal or polymeric material. But it can also be made from for example wood. The hanging profile 20 has an opening 21, which faces downwards, and another opening 27, which for example faces upwards. The downwards facing opening 21 is designed to receive an edge of a poster and different receiving and holding elements can be mounted in the downwards facing opening 21 depending on which form of poster there is to be fixed. The upwards facing opening 27 can be used for mounting of different forms of hanging brackets such that the hanging profile 20 can for example be mounted to a stand or can be mounted towards a ceiling or mounted towards a vertical wall. On the figure it can be seen that the upwards facing opening is a part of a C-profile 26. It is possible to fix the hanging profile to a lower edge of a poster, and in that case, the profile is turned opposite in relation to the placements of up and down in the above-mentioned section. In FIG. 6B is shown an example of this.

As it is seen in FIG. 2, the magnet clip 1 is shorter than the hanging profile 20 such that a number of magnet clips 1 are mountable after each other in the hanging profile's longitudinal direction. Thereby, there is in part possibility of varying the number of magnet clips in the hanging profile and in part it will save space since only the magnet clips to the magnetic connection have not in total got the same length as the hanging profile but only consist a smaller part of its length. A user of the magnetic poster holder unit can now take a hanging profile without magnet clips and by simple sawing through form exactly the length of hanging profile, which fits to a specific purpose, for example for decoration of a shop. Hereafter, the user must hang the profile, mount magnet clips and possibly mount end plugs in the hanging profile. The three actions can be carried out in optional order. If it turns out that the number of magnet clips is to be changed, more can be added and it is also possible to take some out. The poster holder unit thereby provides a high degree of flexibility. Short or long pieces can be provided from a minimum of part elements and decorative hanging can be realized fast and efficiently.

Figure 3:
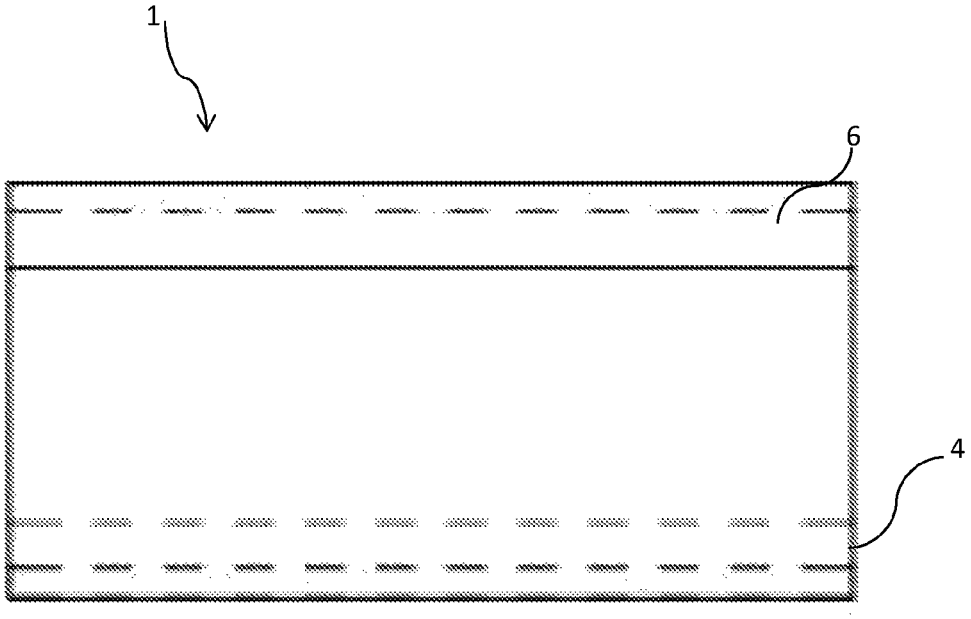
FIG. 3 shows the magnet clip in FIG. 2 seen from the side.
Figure 3A:
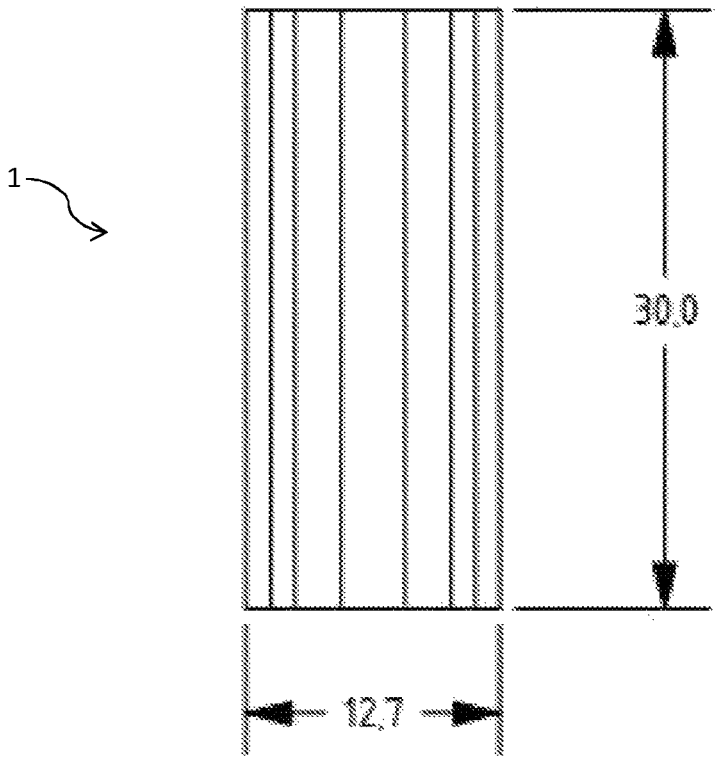
FIG. 3A shows the magnet clip seen from below.

In FIG. 3A, the magnet clip is seen from below and here is also indication of examples of measurements of the item. The magnet clip is thus 30 mm long and 12.7 mm wide on the widest piece.

Figure 3B:
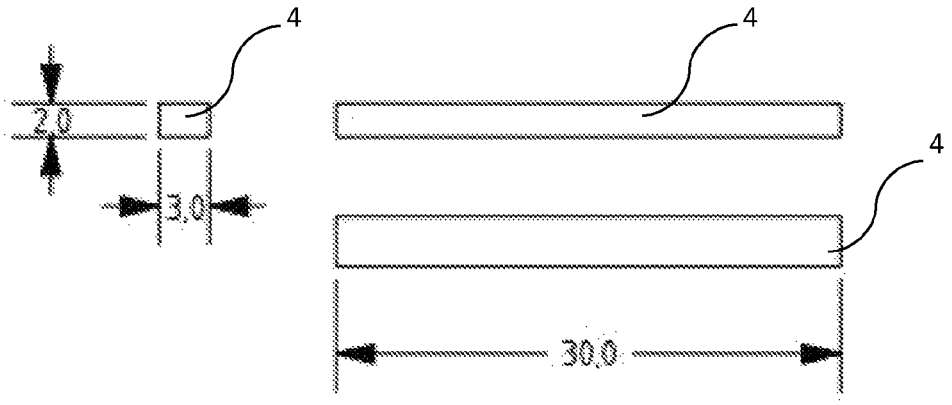
FIG. 3B shows the magnet isolated from the magnet clip.

Likewise, in FIG. 3B, the magnet 4 is shown in a depiction from 3 usual points of view with indication of certain measurements. The magnet has the same length, namely 30 mm and is 2×3 mm in profile. The stated dimensions are only examples of the size of the used elements and according to the size, and not least the weight, of posters, which are to be hanged, there can be scaled either up or down for the sizes, which the magnet clips should have.

Figure 4:
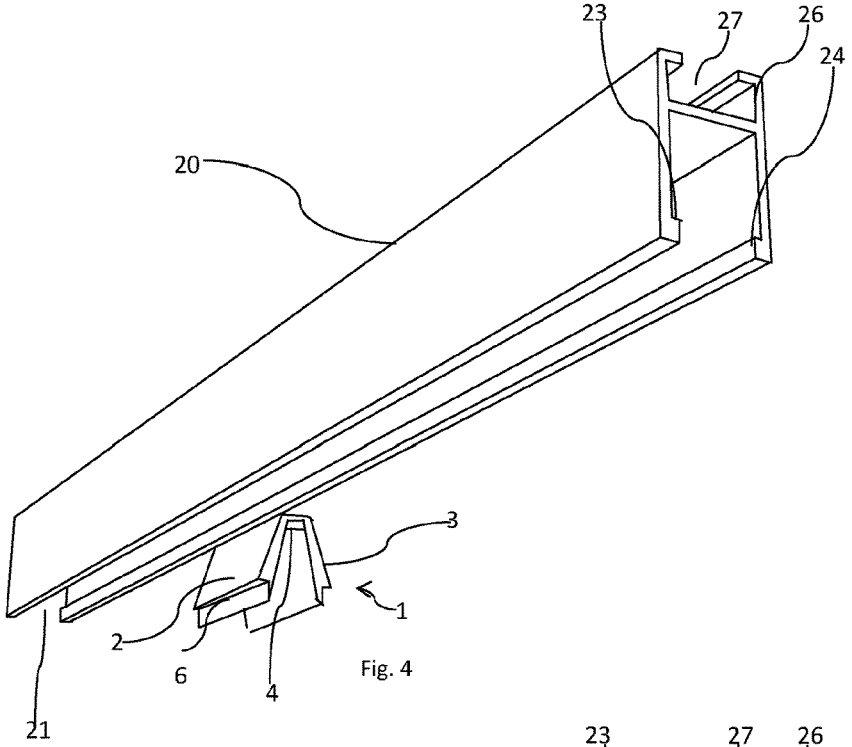
FIG. 4 shows a 3D reproduction of a hanging profile and a magnet clip.
Figure 4A:
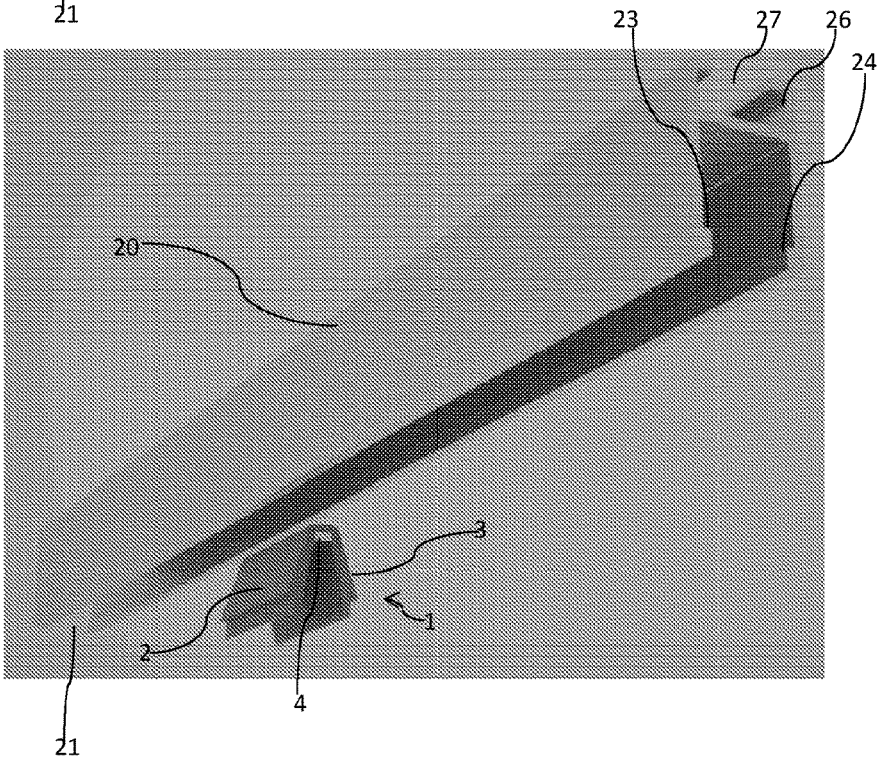
FIG. 4A shows the 3D reproduction in FIG. 4 in a graphic representation

The hanging rail, as shown in FIG. 4 and FIG. 5, comprises a U-shaped profile 22, whereby there on each of the U-profile's legs is provided each own step 23,24, which face towards each other. The U-profile's opening 25 in the longitudinal direction will thus be somewhat narrower than the widest point on the magnet clip 1. The magnet clips and/or the hanging profile's u-profile can be dimensioned such that the legs on respectively the one and/or the other are flexible such that the magnet clips can be clicked in place by the magnet clips 1 being pressed into the u-profile's opening on the hanging profile across the longitudinal direction. Alternatively, the magnet clips can be pushed in from an open end of the hanging profile, like dismounting of the magnet clips occurs appropriately by displacing them out of the u-profile in the longitudinal direction of the hanging profile.

Figure 6:
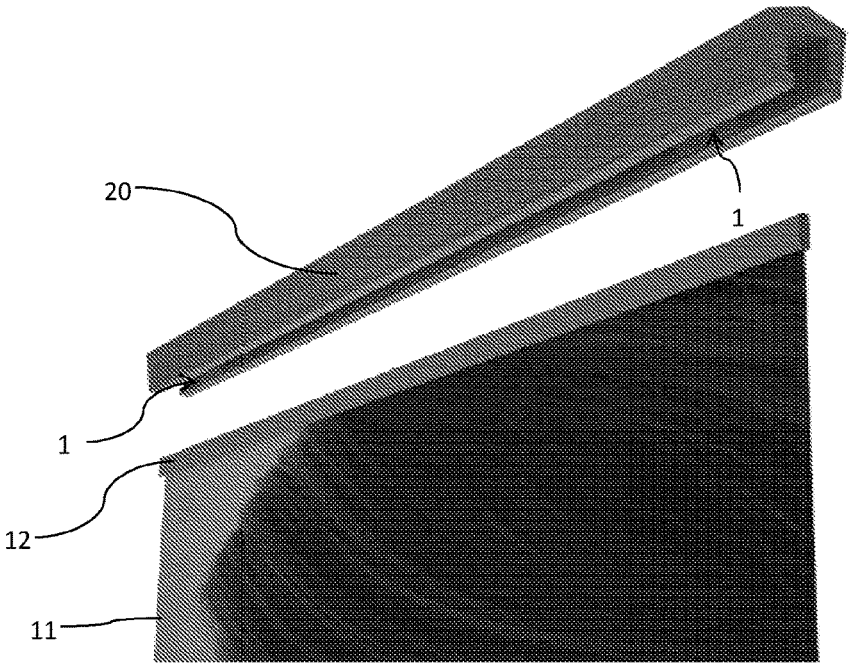
FIG. 6 shows graphical 3D representation of a hanging profile in wood with two magnet clips and a poster with poster edge ready for insertion in the hanging profile.

FIG. 6 shows a poster 11 with a metallic magnetic iron-containing edge rail 12. The edge rail 12 is insertable in the u- or v-shaped magnet clip 1 and detachably fixed hereto by magnetic connection between the poster's edge rail and the magnet or the magnets in the bottom of it or the v- or u-shaped magnet clips. Several magnet clips 1 are clicked into the hanging profile 20.

Figure 6A:
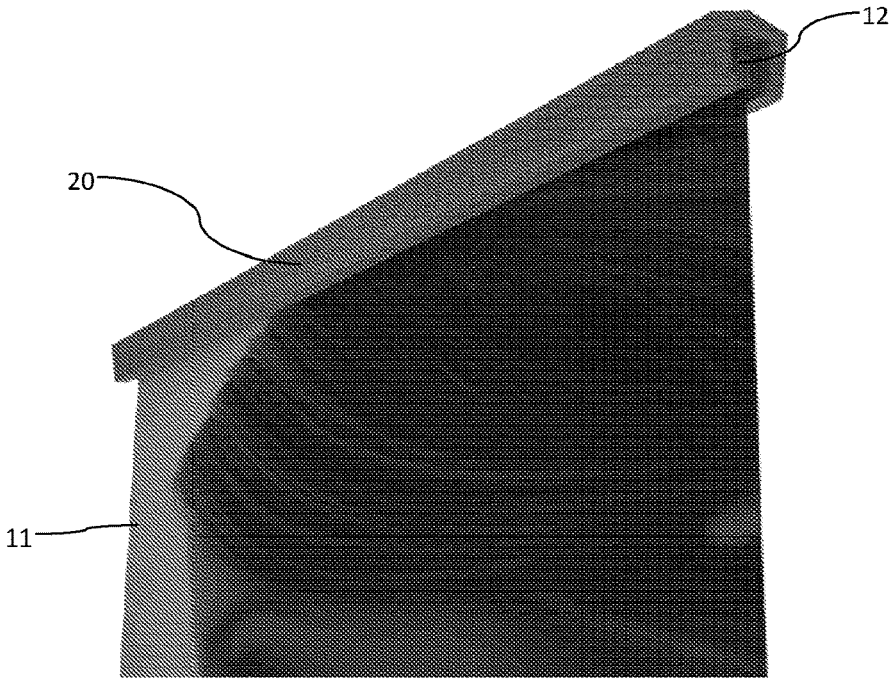
FIG. 6A shows the 3D representation in FIG. 6 with the poster inserted in the magnet clips in the hanging profile.
Figure 6B:
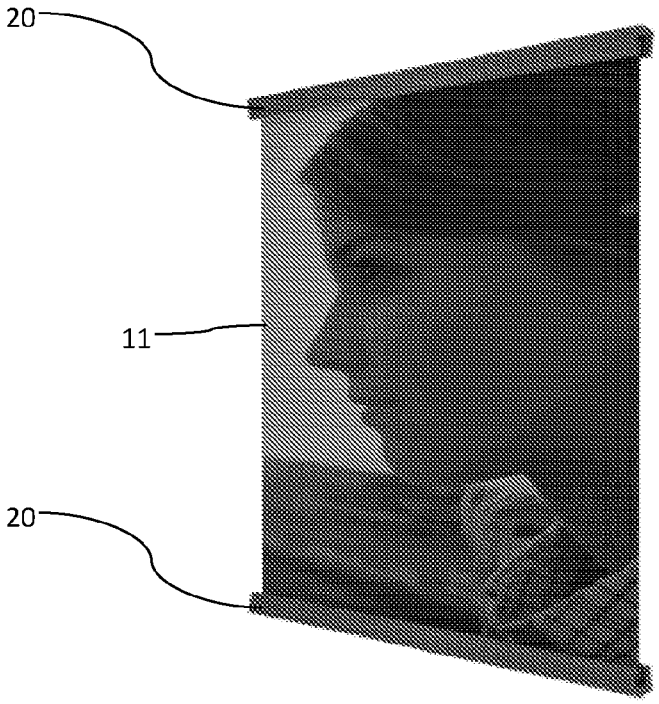
FIG. 6B shows a whole poster with hanging profile mounted both above and at the bottom.

FIG. 6A shows the same poster 11, now with the edge rail 12 inserted and magnetic fixed in the magnet clips. As it is seen, the magnet clips are well hidden by the hanging profile 20, such that they are not visible from the outside.

In FIG. 6B is seen a poster 11, which is stretched between and upper and a lower hanging profile 20.

Figure 7:
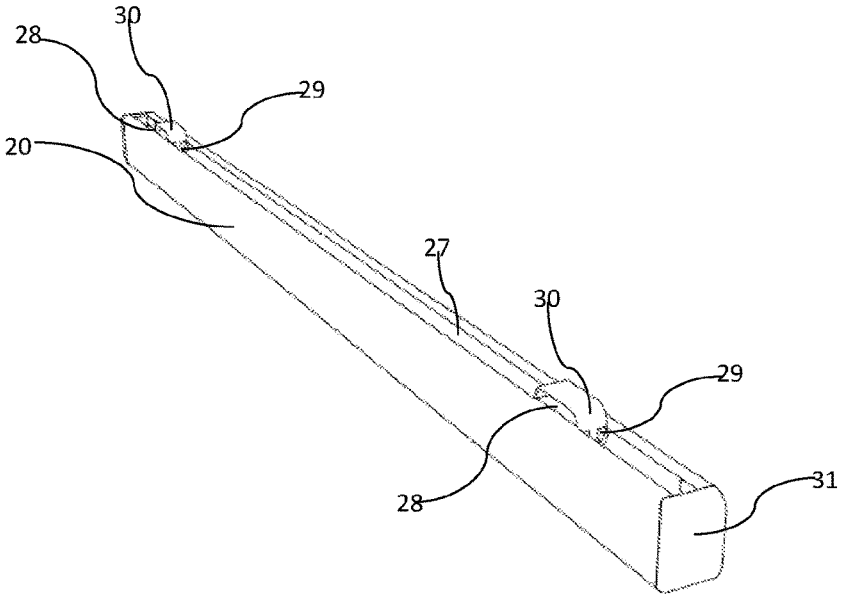
FIG. 7 shows a 3D representation in line drawing of a hanging profile with inserted hanging rings.
Figure 7A:
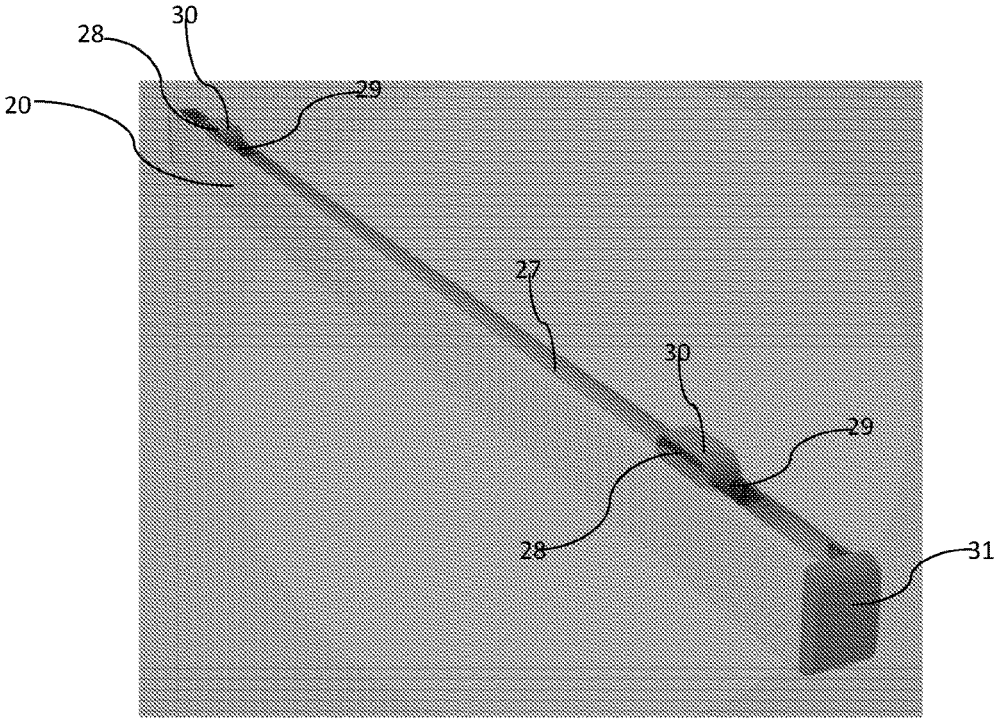
FIG. 7A shows the 3D representation in FIG. 7 in a graphical presentation with grey tones.

In FIG. 7 is seen a 3D representation of a hanging profile 20 seen from above. Here is shown a hanging profile comprising an upwards facing c-shaped profile and down in the opening in the c-shaped profile is mounted two hanging rings 30. Each hanging ring includes partly a ring part 28 and partly a mesh part 29. The mesh part is designed such that it can easily form a detachable mesh down in the c-profile and is fixed in this, while the ring part is designed to receive grippers or cords such that it can be fixed to a rack or to a ceiling. In FIGS. 7 and 7A are furthermore shown end plugs 31, which can finally be mounted by the user in order to achieve a cosmetic and practically rounded off end of the hanging profile.

The invention claimed is:

1. A method for hanging a flat, flexible length of material along a poster edge, wherein the poster edge comprises magnetizable iron and the magnetizable iron is brought to contact against a magnet clip comprising corresponding magnets for detachable magnetic fixing of the poster edge against the magnet clip, and wherein the magnet clip is detachably connected with a hanging profile by being inserted into the hanging profile in its longitudinal direction or in a transverse direction of the hanging profile;

wherein the hanging profile has an inner shape and a pair of legs, wherein each leg is provided with a step, and wherein each step faces towards the opposing step;

wherein the magnet clip is configured for insertion into the inner shape of the hanging profile and having a pair of legs each having a notch on an end thereof; and wherein each notch of the magnet clip is configured to provide a mechanical locking and thereby fixation between the magnet clip and the hanging profile when the magnet clip is inserted into the hanging profile;

wherein the vertical size of each step and the vertical size of each notch on the magnet clip are the same and the horizontal size of each step and the horizontal size of each notch on the magnet clip are the same, such that the notches will go in mesh with the steps when the magnet clip is inserted into the hanging profile; and wherein the magnet clip is shorter than the hanging profile such that a number of magnet clips are mountable after each other in a longitudinal direction of the hanging profile.

2. The method according to 1, wherein the flat, flexible length of material is released from the hanging profile by pulling an edge of the material with the magnetizable iron free from the magnets of the magnet clip.

3. A magnetic poster holder unit, comprising:

a hanging profile having an inner shape and a pair of legs, wherein each leg is provided with a step, and wherein each step faces towards the opposing step; and a magnet clip configured for insertion into the inner shape of the hanging profile and having a magnet, and a pair of legs each having a notch on an end thereof;

wherein each notch of the magnet clip is configured to provide a mechanical locking and thereby fixation between the magnet clip and the hanging profile when the magnet clip is inserted into the hanging profile;

wherein the vertical size of each step and the vertical size of each notch on the magnet clip are the same and the horizontal size of each step and the horizontal size of each notch on the magnet clip are the same, such that the notches will go in mesh with the steps when the magnet clip is inserted into the hanging profile; and wherein the magnet clip is shorter than the hanging profile such that a number of magnet clips are mountable after each other in a longitudinal direction of the hanging profile.

4. The magnetic poster holder unit according to claim 3, wherein the hanging profile is comprised of an extruded profile made from light metal, polymeric material or wood.

5. The magnetic poster holder unit according to claim 3, wherein the hanging profile comprises one or more brackets for fixation of the hanging profile to a wall, a ceiling or a rack.

6. The magnetic poster holder unit according to claim 3, wherein a poster having a metallic magnetic iron-containing edge rail is insertable in the magnet clip and detachably fixed hereto by a magnetic connection between the edge rail and the magnet in magnet clip.

7. The magnetic poster holder according to claim 3, wherein the hanging profile is designed as a u-shaped profile.

* * * * *